United States Patent [19]

Guslits

[11] Patent Number: 4,806,991

[45] Date of Patent: Feb. 21, 1989

[54] MECHANISM FOR LOCATING A FLEXIBLE PHOTOCONDUCTOR RELATIVE TO A DEVELOPMENT STATION

[75] Inventor: Vladimir S. Guslits, Rochester, N.Y.

[73] Assignee: Eastman Kodak Company, Rochester, N.Y.

[21] Appl. No.: 135,860

[22] Filed: Dec. 21, 1987

[51] Int. Cl.[4] ..... G03G 15/08

[52] U.S. Cl. ..... 355/3 DD; 355/14 D; 355/3 BE; 118/657

[58] Field of Search ..... 355/3 BE, 3 DD, 16, 355/14 D; 118/257, 647, 651; 354/318

[56] References Cited

U.S. PATENT DOCUMENTS

| | | | |
|---|---|---|---|
| 3,974,952 | 8/1976 | Swanke et al. | 226/189 |
| 3,995,585 | 12/1976 | Schuurmans | 354/318 X |
| 4,114,536 | 9/1978 | Kaneko et al. | 355/3 BE X |
| 4,361,112 | 11/1982 | DiNallo et al. | 118/661 |
| 4,398,496 | 8/1983 | Kopko | 355/3 DD |
| 4,565,437 | 1/1986 | Lubinsky | 355/3 DD |
| 4,575,217 | 3/1986 | Bothner | 355/3 DD |
| 4,630,919 | 12/1986 | Fantuzzo et al. | 355/3 BE X |
| 4,699,500 | 10/1987 | Lubberts et al. | 355/4 |

OTHER PUBLICATIONS

*Xerox Disclosure Journal,* vol. 7, No. 3, May/Jun. 1982, pp. 199–201.

*Research Disclosure,* Jun. 1979, Item No. 18272, pp. 347–348.

*Primary Examiner*—A. C. Prescott

*Assistant Examiner*—Jane Lau

*Attorney, Agent, or Firm*—Tallam Nguti

[57] ABSTRACT

A reproduction apparatus has a flexible photoconductor that is moved along an endless path and past a development station for developing latent images on one surface of the photoconductor. A back-up roller is adjacent the other surface of the photoconductor. A mechanism urges the roller against the photoconductor to move it toward the station in response to insertion of the station into the reproduction apparatus. The mechanism has arms alongside the path of the photoconductor that are engageable with stops on the station to precisely locate the roller, and thus the photoconductor, relative to the station.

6 Claims, 2 Drawing Sheets

MECHANISM FOR LOCATING A FLEXIBLE PHOTOCONDUCTOR RELATIVE TO A DEVELOPMENT STATION

BACKGROUND OF THE INVENTION

This invention relates to a mechanism for locating a back-up roller inside an endless photoconductor and opposite a magnetic brush of a development station on the outside of the photoconductor so that the photoconductor is precisely located with respect to the station.

U.S. Pat. No. 3,974,952 entitled Web Tracking Apparatus issued on Aug. 17, 1976 in the names of T. Swanke et al. The apparatus disclosed in that patent includes a pair of spaced, fixed plates for supporting a plurality of rollers. An endless flexible photoconductor is carried by the rollers and advanced past a series of stations, including a development station that is outside the endless loop formed by the photoconductor. A series of back-up rollers between the plates are located inside the loop formed by the photoconductor and opposite the development station to help establish the plane of the photoconductor relative to the development station.

Apparatus as generally described above has been used successfully in prior copiers/duplicators. In one such copier/duplicator, as the development station is moved into place relative to the photoconductor, the toning roller of a magnetic brush apparatus is located with respect to the back-up roller (and thus the photoconductor) by a four-point mounting including a guide. This system has several disadvantages. For example, the four point system is an over restrained system, it does not always provide the required accuracy of alignment relative to the back-up rollers and photoconductors, and it makes removal of the station difficult. In another copier/duplicator the development station moves into position in a tray and adjustments are provided to move the toning roller with respect to the photoconductor and the back-up roller. These prior systems work satisfactorily even though the back-up roller, toning roller and photoconductor may not be precisely located with respect to each other, especially in a front-to-rear direction (i.e., laterally relative to the photoconductor). However, a new development station for an improved developer material requires more accuracy in establishment of the plane of the photoconductor with respect to the toning roller. Thus, improved mechanisms are needed to meet this requirement.

SUMMARY OF THE INVENTION

Accordingly, it is an object of the invention to improve the accuracy of the alignment of a flexible photoconductor relative to a development station, especially in a lateral direction relative to the photoconductor. Another object is to provide accurate positioning of the photoconductor relative to the development station while avoiding an over restrained system and without complicating removal of the development station. The present invention can be used in a reproduction apparatus having a flexible photoconductor trained about a plurality of rollers for movement along a path. The photoconductor has first and second surfaces, and a development station is positioned along the path adjacent the first surface for developing latent images on the first surface of the photoconductor. The mechanism of the invention is used for locating the photoconductor relative to the station, and comprises means defining two spaced stops on the station. A back-up roller is mounted adjacent the second surface of the photoconductor for movement toward and away from the development station. The roller is effective when moved toward the development station to deflect the photoconductor toward the development station. Means associated with the mounting means and engageable with the stops limits movement of the back-up-roller, and thus the photoconductor, toward the development station, thereby establishing the location of the photoconductor relative to the station.

BRIEF DESCRIPTION OF THE DRAWINGS

In the detailed description of the preferred embodiment of the invention presented below reference is made to the accompanying drawings, in which.

DETAILED DESCRIPTION OF THE INVENTION

Figure 1:
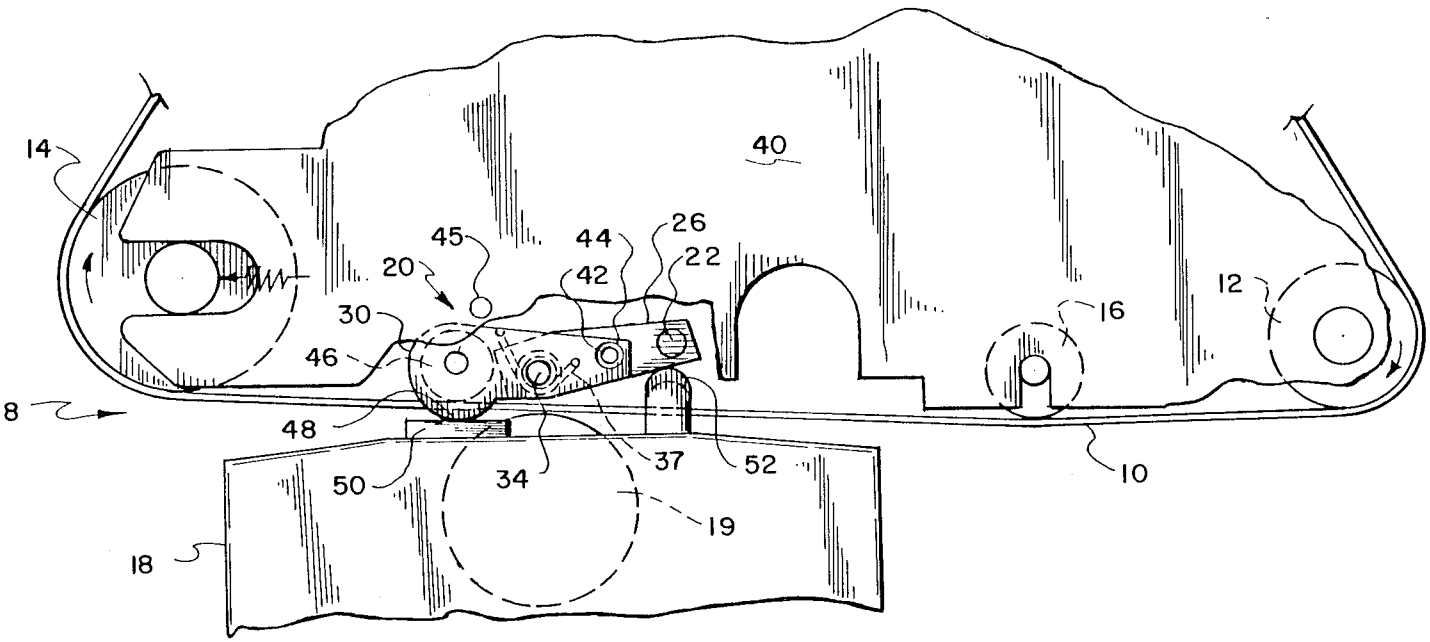
FIG. 1 is an elevation view of portions of a reproduction apparatus incorporating a preferred embodiment of a mechanism of the inventions for locating a back-up roller and photoconductor relative to the applicator of a development station.

The mechanism of the invention can be used with a reproduction apparatus, a portion of which is generally designated 8. Apparatus 8 can be an electrographic copier/duplicator as generally disclosed in the before-mentioned U.S. Pat. No. 3,974,952, and the disclosure of such patent is incorporated herein. The apparatus 8 includes a photoconductor 10 that is supported for movement along an endless path by a plurality of rollers, three of which are shown at 12, 14 and 16. Roller 16, together with roller 12, holds the photoconductor flat in an image plane so that a latent image can be formed on the photoconductor.

The apparatus 8 has a development station generally shown at 18 including an applicator, such as a toning roller 19 of a magnetic brush. Station 18 is moved into its operative position in apparatus 8 on rails (not shown) and located in a fixed position with respect to the rollers 12, 14 and 16. Station 18 is outside the endless path of the photoconductor and below the portion of the photoconductor between rollers 14 and 16.

Figure 2:
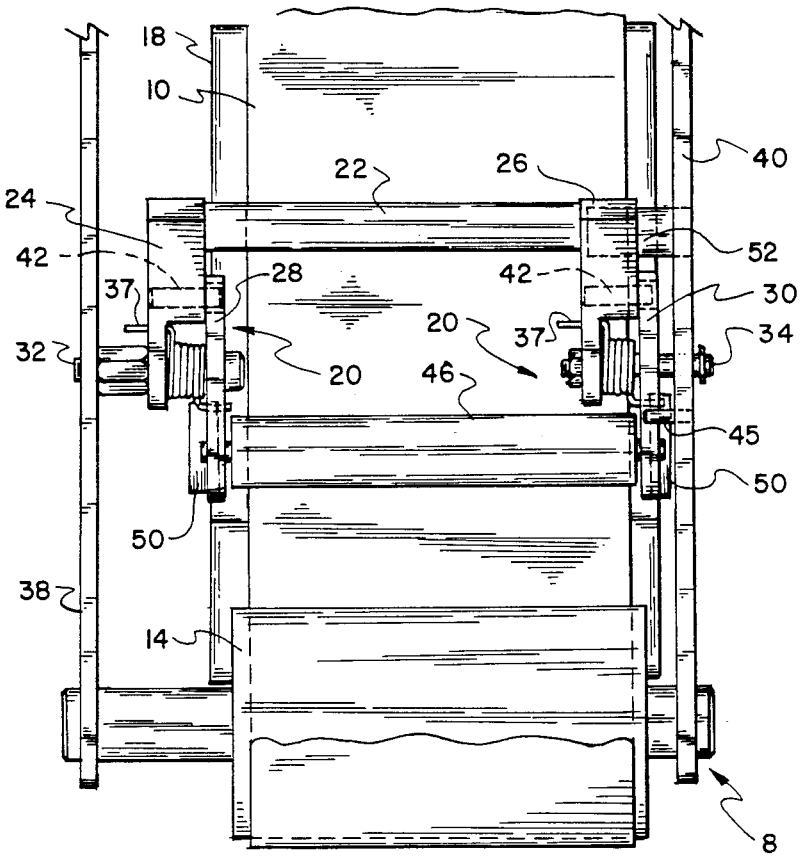
FIG. 2 is a fragmentary plane view of portions of the FIG. 1 apparatus.

The mechanism of the invention for urging the photoconductor into position with respect to the development station is generally designated 20. Mechanism 20 includes a bar 22 spaced from the photoconductor and positioned within the loop formed by the photoconductor as shown in FIG. 2, two arms 24 and 26 are rigidly secured to the ends of bar 22. Two additional arms 28, 30 are connected to arms 24, 26, respectively, by pivots 32 and 34. Arms 28, 30 straddle the side edges of the photoconductor as shown in FIG. 2. Arms 28 and 30 are urged in a counterclockwise direction about the pivots by suitable springs. For example, a torque spring 37 can be coiled around each of the pivots 32, 34 and have its ends connected to arms 24, 26, and to arms 28, 30 to affect the desired spring biasing.

Fixed plates 38, 40 at the rear and front, respectively, of the reproduction apparatus support the rollers 12, 14 and 16 and the photoconductor in the manner generally disclosed in the before-mentioned U.S. Pat. No. 3,974,952. Mechanism 20 also is supported by these plates. More specifically, arms 24 and 26 are connected by pivots 32 and 34 to rear and front plates 38, 40, respectively. Pivotal movement of the arms 28 and 30 is limited by a pin 42 on each arm which projects through a slot 44 (FIG. 1) in arms 24, 26. Thus the interaction between the pin and slot determines the extent of relative pivotal movement between arms 28, 30 and the corresponding arms 24, 26. A pin 45 projects from plate 40 to a position over the top of arm 30. Pin 45 limits upward movement of arm 30, and thus limits movement of all of the mechanism 20 about pivots 32, 34.

A back-up roller 46 for the photoconductor is located inside the endless loop of the photoconductor. Roller 46 is carried by the arms 28, 30 and is movable by the arms into and out of engagement with the inner surface of the photoconductor. Movement of the roller 46 toward the photoconductor 10 is limited by projections on the bottom of each arm 28 and 30, such as shown at 48 for arm 30 in FIG. 1. Such projections are engageable with stops 50 that are fixed with respect to the frame and roller 19 of the development station 18. The stops are located directly below the projections 48, and both the stops and projections are laterally offset from the path of photoconductor 10. Thus arms 28, 30 can move the roller into engagement with the photoconductor to deflect it downwardly out of a plane between the bottom of rollers 14, 16 and locate the photoconductor in a precise position with respect to roller 19 of station 18.

The development station 18 has a ramp-shaped cam 52 (FIGS. 1 and 2). When the station is moved into position in the reproduction apparatus the upper edge of the cam engages the bottom of arm 26 to urge the arm upwardly about its pivot 34. This movement is transferred through bar 22 to arm 24, causing it to move about its pivot 32. As arms 24, 26 are pivoted, springs 37 urge the back-up roller 46 downwardly into contact with the photoconductor. The force of springs 37 urges arms 28, 30 downwardly until the projections 48 independently engage the stops 50. The back-up roller 46, together with roller 16, then establishes the location of the photoconductor 10 with respect to the toning roller 19 in station 18.

Figure 3:
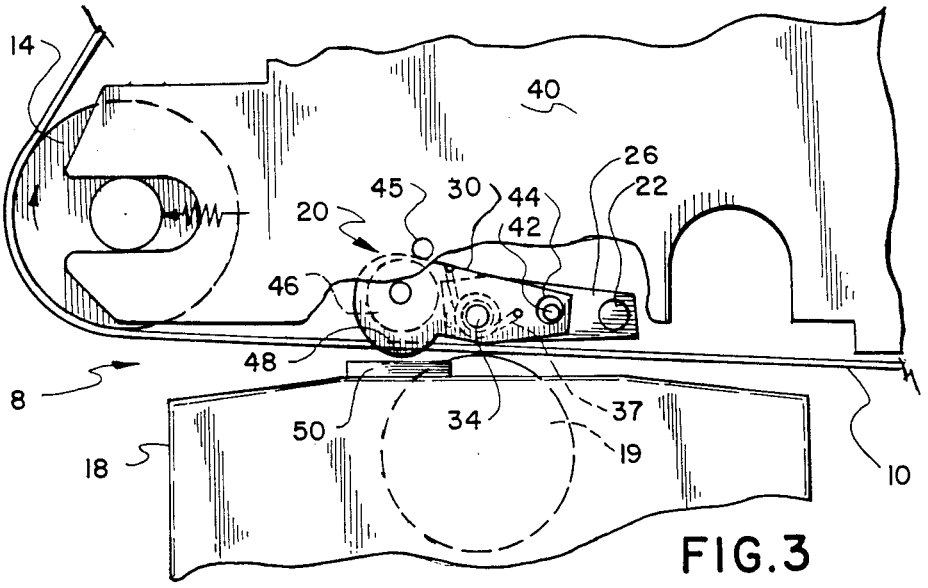
FIG. 3 is a detail view of part of the FIG. 1 mechanism showing a second position of some of the parts.

Operation of the apparatus of the invention will now be described. With the development station 18 at least partly removed from the apparatus as shown in FIG. 3, cam 52 is separated from arm 26. This permits the force of gravity to swing the mechanism 20 about pivots 32 and 34 to a position shown in FIG. 3 where the upper edge of arm 30 contacts stop pin 45. This locates roller 46 in its raised position away from photoconductor 10. Under these conditions arms 24 and 26 will be lowered clockwise about pivots 32, 34. With roller 46 elevated, photoconductor 10 will be in a substantially flat plane between the bottom of rollers 14 and 16.

During movement of station 18 into its loaded position in the reproduction apparatus, it moves freely beneath the plane of the photoconductor because mechanism 20 is in its FIG. 3 position and the photoconductor is above the path of the station. As station 18 reaches its fully loaded position, cam 52 engages the bottom surface of arm 26 to pivot the arm in a counterclockwise direction about pivot 34 to its FIG. 1 position. This movement is translated through bar 22 to the arm 24 to cause corresponding movement of arm 24. The torsion springs 37 then exert a force on arms 28, 30 causing them to swing in a counterclockwise direction about pivots 32 and 34 until both the projections 48 engage the stops 50 on the station 18. As this occurs the roller 46 contacts the inner surface of the photoconductor 10 to move the photoconductor downwardly relative to the toning roller 19. This locates the photoconductor in a plane between the bottom of roller 16 and the bottom of roller 46, such plane being just above the toning roller 19. The plane of the photoconductor relative to the toning roller is very precisely located because the projections 48 are on the arms 28, 30 that support the roller 46, and such projections contact the stops 50 at the front and rear of the development station, such stops being fixed with respect to toning roller 19.

It is important that the roller 46 be precisely located with respect to the development station at both the front and rear ends of the station. One reason such precise location is achieved with mechanism 20 is that springs 37 urge the arms 28, 30 independently toward stops 50. After the projection 48 on one of these arms strikes a stop 50, the other arm can continue to move independently until it too strikes its stop 50. Thus both arms will contact their respective stops to exactly locate the roller 46 relative to the stops, and also relative to roller 19.

The mechanism of the invention for locating the photoconductor relative to the toning roller is not an over restrained system as used in some prior apparatus. Also, it quite accurately aligns the back-up roller 46 and thus the photoconductor relative to the toning roller 19 with great precision so that there is little or no variability between the spacing of the photoconductor at the edge thereof nearest the front of the reproduction apparatus as compared to the spacing near the rear of the reproduction apparatus. Thus the apparatus of the invention is usable with developer materials which require the photoconductor to be established very precisely with respect to the toning roller. Moreover, the apparatus of the invention does not interfere with the removal or insertion of station 18.

The invention has been described in detail with particular reference to a preferred embodiment thereof, but it will be understood that variations and modifications can be effected within the spirit and scope of the invention as described hereinabove and as defined in the appended claims.

I claim:

1. In a reproduction apparatus having a flexible photoconductor trained about a plurality of rollers for movement along a path, the photoconductor having first and second surfaces, and a development station positioned along the path adjacent the first surface for developing latent images on the first surface of the photoconductor, an improved mechanism for locating the photoconductor relative to the station comprising:

means defining two spaced stops on the station, a back-up roller, means mounting the back-up roller adjacent the second surface of the photoconductor for movement toward and away from the development station, the roller being effective when moved toward the development station to deflect the photoconductor toward the development station, and means associated with the mounting means and engageable with the stops for limiting movement of the back-up roller and thus the photoconductor toward the development station, thereby establishing the location of the photoconductor relative to the station.

2. The invention as set forth in claim 1 wherein the stops are laterally offset from the path of the photoconductor, the mounting means are arms at the ends of the back-up roller, and the limiting means comprise projections on the arms.

3. The invention as set forth in claim 2 wherein the development station is movable into and out of an operative position in the reproduction apparatus, and the invention further comprises means for automatically moving the back-up roller toward the development station in response to the station being moved into its operative position.

4. In a reproduction apparatus having a flexible photoconductor trained about a plurality of rollers for movement along a path, the photoconductor having first and second surfaces, and a development station positioned along the path adjacent the first surface for developing latent images on the first surface of the photoconductor, an improved mechanism for locating the photoconductor relative to the station comprising:

means defining two spaced stops on the station, one stop being laterally offset from one side of the path and the other stop being laterally offset from the other side of the path, a bar adjacent the second surface of the photoconductor, first and second arms rigidly secured to opposite ends of the bar, means for pivotally mounting the first and second arms for movement about an axis, a third arm pivotally connected to the first arm, a fourth arm pivotally connected to the second arm, a back-up roller carried by the third and fourth arms and located adjacent the second surface of the photoconductor, means for independently urging the third and fourth arms about their respective pivotal connection to the first and third arms, means on the third and fourth arms engageable wtih the stops in response to movement of such arms for locating the back-up roller precisely relative to the development station, thereby locating the photoconductor relative to the station.

5. The invention as set forth in claim 4 wherein the urging means comprises a first spring connected to the first and third arms and a second spring connected to the second and fourth arms, and further comprising means limiting pivotal movement of the third and fourth arms relative to the first and second arms.

6. The invention as set forth in claim 4 wherein the station has a cam engageable with the first arm for moving the first and second arms in response to positioning the station in the reproduction apparatus.

* * * * *